US011002131B2

(12) United States Patent
Smart et al.

(10) Patent No.: US 11,002,131 B2
(45) Date of Patent: May 11, 2021

(54) DIRECTIONAL CONTROL OF WELLBORE TRAJECTORIES

(71) Applicant: Gyrodata, Incorporated, Houston, TX (US)

(72) Inventors: Barry Smart, Aberdeen (GB); Adrián Guillermo Ledroz, Houston, TX (US); John Lionel Weston, Christchurch (GB)

(73) Assignee: Gyrodata, Incorporated, Houston, TX (US)

( * ) Notice: Subject to any disclaimer, the term of this patent is extended or adjusted under 35 U.S.C. 154(b) by 244 days.

(21) Appl. No.: 16/206,690

(22) Filed: Nov. 30, 2018

(65) Prior Publication Data

US 2019/0169984 A1 Jun. 6, 2019

Related U.S. Application Data

(60) Provisional application No. 62/593,648, filed on Dec. 1, 2017.

(51) Int. Cl.

| | |
|---|---|
| ***E21B 47/12*** | (2012.01) |
| ***E21B 47/01*** | (2012.01) |
| ***E21B 7/06*** | (2006.01) |
| ***E21B 47/024*** | (2006.01) |

(52) U.S. Cl.

CPC ..... *E21B 47/12* (2013.01); *E21B 7/06* (2013.01); *E21B 47/01* (2013.01); *E21B 47/024* (2013.01)

(58) Field of Classification Search

CPC ..... E21B 47/12; E21B 47/01; E21B 47/024; E21B 7/06

See application file for complete search history.

(56) References Cited

U.S. PATENT DOCUMENTS

| | | | | |
|---|---|---|---|---|
| 6,381,858 | B1 * | 5/2002 | Shirasaka | E21B 47/022 33/304 |
| 9,062,537 | B1 * | 6/2015 | Holt | E21B 44/00 |
| 2005/0224257 | A1 | 10/2005 | Ekseth et al. | |
| 2009/0084546 | A1 | 4/2009 | Ekseth et al. | |
| 2010/0096186 | A1 * | 4/2010 | Ekseth | E21B 7/10 175/45 |
| 2010/0100329 | A1 | 4/2010 | Ekseth et al. | |
| 2013/0282290 | A1 | 10/2013 | Weston et al. | |
| 2016/0032709 | A1 * | 2/2016 | Ledroz | G01C 19/02 73/152.54 |

FOREIGN PATENT DOCUMENTS

EP 2759674 A2 7/2014

OTHER PUBLICATIONS

PCT Search Report; PCT/US2018/063628; dated Mar. 15, 2019.

Ekseth, R., et al., "High-Integrity Wellbore Surveying", SPE Drilling & Completion, Dec. 2010, pp. 438-447.

* cited by examiner

*Primary Examiner* — Yong-Suk (Philip) Ro

(74) *Attorney, Agent, or Firm* — Pramudji Law Group PLLC; Ari Pramudji

(57) ABSTRACT

Various implementations described herein refer to a method. The method may include receiving first gyro-while-drilling (GWD) survey data acquired using a first survey tool disposed within a wellbore. The method may include receiving second GWD survey data acquired using a second survey tool disposed within the wellbore. The method may include generating a survey of the wellbore based on the first GWD survey data and the second GWD survey data for directional control of wellbore trajectories.

20 Claims, 5 Drawing Sheets

400

Difference in Duration of Single and Dual GWD Survey Procedures

DIRECTIONAL CONTROL OF WELLBORE TRAJECTORIES

CROSS-REFERENCE TO RELATED APPLICATIONS

This application claims priority to and the benefit of U.S. Provisional Application No. 62/593,648, entitled "Dual Gyro-While-Drilling System", filed Dec. 1, 2017, which is incorporated herein by reference in its entirety.

BACKGROUND

This section is intended to provide information relevant to understanding the various technologies described herein. As the section's title implies, this is a discussion of related art that should in no way imply that it is prior art. Generally, related art may or may not be considered prior art. It should therefore be understood that any statement in this section should be read in this light, and not as any admission of prior art.

Within the oil and gas industry, there is need for reliable high accuracy wellbore placement, which is widely recognized. Real-time three-dimensional (3D) orientation and positional data of both the drill bit and drilled sections of the well under construction may be needed to steer the drill bit safely towards a drilling target and to avoid collisions with adjacent wells. For instance, access to 3D positional data for such wells may be used for collision avoidance. Thus, high quality and verifiable survey data may be used to minimize or at least reduce drilling risk and potential liabilities when drilling a well.

SUMMARY

Described herein are various implementations of a method. The method may include receiving first gyro-while-drilling (GWD) survey data acquired using a first survey tool disposed within a wellbore. The method may include receiving second GWD survey data acquired using a second survey tool disposed within the wellbore. The method may include generating a survey of the wellbore based on the first GWD survey data and the second GWD survey data for directional control of wellbore trajectories.

Described herein are various implementations of an apparatus. The apparatus may include a first survey tool disposed within a wellbore, and the first survey tool may acquire first gyro-while-drilling (GWD) survey data. The apparatus may include a second survey tool disposed within the wellbore, and the second survey tool may acquire second GWD survey data. The apparatus may include a controller that receives the first GWD survey data from the first survey tool, receives the second GWD survey data from the second survey tool, and generates a survey of the wellbore based on the first GWD survey data and the second GWD survey data for directional control of wellbore trajectories.

Described herein are various implementations of a non-transitory computer-readable medium having stored thereon a plurality of computer-executable instructions that, when executed by a processor, cause the processor to receive first gyro-while-drilling (GWD) survey data acquired using a first survey tool disposed within a wellbore. The instructions may cause the processor to receive second GWD survey data acquired using a second survey tool disposed within the wellbore. The instructions may cause the processor to generate at least one survey of the wellbore based on the first GWD survey data and the second GWD survey data for directional control of wellbore trajectories.

The above referenced summary section is provided to introduce a selection of concepts in a simplified form that are further described below in the detailed description section. Additional concepts and various other implementations are also described in the detailed description. The summary is not intended to identify key features or essential features of the claimed subject matter, nor is it intended to be used to limit the scope of the claimed subject matter, nor is it intended to limit the number of inventions described herein. Furthermore, the claimed subject matter is not limited to implementations that solve any or all disadvantages noted in any part of this disclosure.

BRIEF DESCRIPTION OF THE DRAWINGS

Implementations of various techniques are described herein with reference to the accompanying drawings. It should be understood, however, that the accompanying drawings illustrate only various implementations described herein and are not meant to limit embodiments of various techniques described herein.

DETAILED DESCRIPTION

Figure 1:
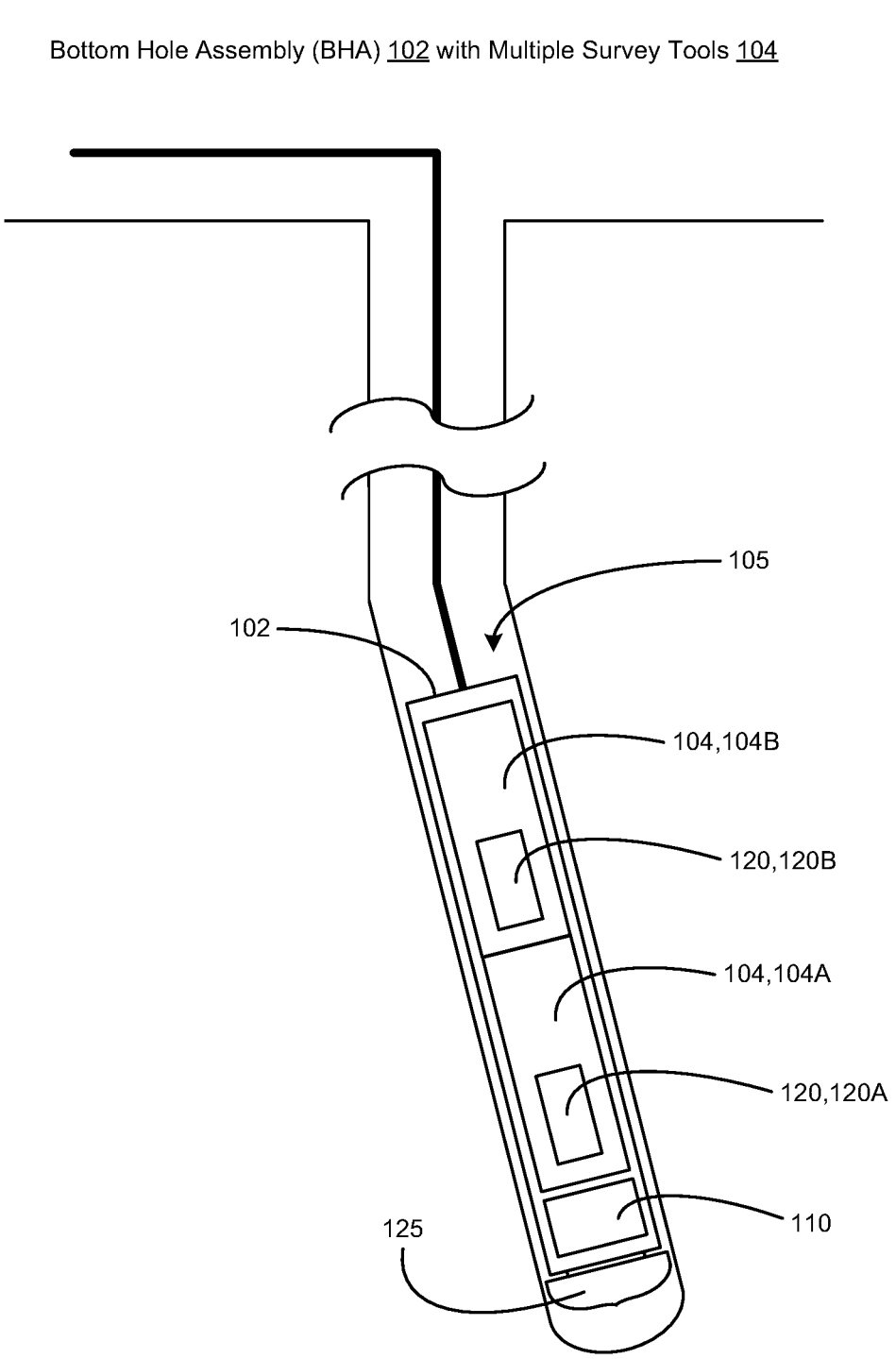
FIG. 1 illustrates a diagram of a bottom hole assembly (BHA) in accordance with various implementations described herein.

In recent years, demand has grown for survey tools that meet well placement objectives as part of the drilling process. Such survey tools may be capable of providing surveys of wellbore trajectories, including, e.g., highly deviated, horizontal and high angle sidetrack wells. Sometimes, to meet these wellbore objectives while a well is being drilled, downhole survey tools may be sufficiently rugged enough to withstand and survive rigors of drilling environments. They may also be capable of generating reliable survey data in parts of a well, irrespective of well inclination and direction, and also when drilling close to existing wells where magnetic interference becomes a concern.

In recent years, the objectives set out above may be fulfilled using gyroscopic surveying methods, through application of gyro-while-drilling (GWD) techniques, wherein a survey may be conducted when the drilling tool is or becomes stationary at each pipe connection. In various implementations, two or three gyroscopic measurements of the components of Earth's rate to which the drilling tool is subjected in mutually orthogonal directions, in combination with three accelerometer measurements of the specific force due to gravity, are taken and used to form an estimate of tool azimuth (A). The following equations may be implemented for this purpose.

$$A = \arctan\left[\frac{\omega_x \cos\alpha - \omega_y \sin\alpha}{(\omega_x \sin\alpha + \omega_y \cos\alpha)\cos I + \omega_z \sin I}\right] \quad (1)$$

$$\alpha = \arctan\left[\frac{-g_x}{-g_y}\right] \quad (2)$$

$$I = \arctan\left[\frac{\sqrt{g_x^2 + g_y^2}}{g_z}\right] \quad (3)$$

where α represents tool-face angle, I represents the inclination angle, gx, gy, and gz represent measurements of orthogonal components of the Earth's gravitation vector, A represents azimuth, ωx represents a measurement of the Earth's rotation rate about the x-axis of the survey tool, ωy represents a measurement of the Earth's rotation rate about the y-axis of the survey tool, and ωz represents a measurement of the Earth's rotation rate about the z-axis of the survey tool.

The collection of the data used to extract directional survey information may be conducted at intervals throughout the drilling process, normally when the drilling tool becomes stationary. This may involve the collection of multiple gyroscopic measurements (e.g., such as over a period of 20-30 seconds), which may then be averaged so as to minimize the effect of measurement noise on the survey reading.

In addition, at least two separate surveys may be taken at each station. This practice may be recommended, particularly, when taking surveys in top-hole sections of off-shore wells, where the drilling tool may not be substantially stationary while taking a survey. Specifically, there may be movement of the bottom hole assembly (BHA) as a result of heave motion of the surface rig or the underlying effect of sea currents around the drill pipe. In this situation, it may be considered advisable to repeat a survey at least once to check for consistency and gain confidence in the result. In some instances, this may also involve communicating with the drilling tool, such as through downlinking or recycling the pumps. After the drilling tool receives the command, a second survey may be initiated. As such, these various procedural steps may take time to implement and prolong the time needed to remain at each survey station, thereby taking up valuable rig time and incurring significant expense.

Therefore, various implementations for a dual GWD system are described herein. These various implementations may include one or more schemes and/or techniques for reducing the time needed to conduct a survey at each station using various gyro based methods by deploying two or more GWD tools in the same BHA. In some implementations, the two GWD tools may be mounted relatively close together in the borehole well so as to ensure that they have similar orientation. Also, the multiple surveys conducted by the two or more survey tools may also be staggered in time to ensure that they are taken at different phases of any along-hole motion to which they may be subjected. Further, each survey tool includes sensors configured to generate measurement data corresponding to instrument orientation with respect to one or more reference directions and/or to the Earth's gravity, where the measurements may be used to determine azimuth and inclination along the wellbore.

For instance, each of the survey tools may include one or more accelerometers that are configured to measure one or more components of the Earth's gravity, wherein these measurements may be used to generate an inclination angle and a tool-face angle of the survey tool. Also, each survey tool may include one or more gyroscopic sensors that are configured to provide measurements of the Earth's rotation rate with respect to two or three orthogonal axes of the respective GWD survey tools. In one implementation, the one or more gyroscopic sensors of each tool may include three single-axis gyroscopic sensors or two dual-axis gyroscopic sensors, which are used to provide measurements of the Earth's rotation rate with respect to the x, y, and z axes of the respective survey tools. Further, the survey tools may also include any other sensors (e.g., magnetometers) that are known to those skilled in the art.

Various implementations of sensor integration for directional control of wellbore trajectories will now be described herein with reference to FIGS. 1-6.

Various implementations described herein are directed to enhanced directional control of wellbore trajectories. For instance, various schemes and techniques described herein are related to incorporating one or more gyroscopic sensors within a BHA having multiple survey tools to provide enhanced directional control of wellbore trajectories through use of dual GWD systems. The various implementations described herein may provide for more precise survey measurements of wellbore surveys so as to allow enhanced wellbore trajectory control.

FIG. 1 illustrates a diagram 100 of an apparatus 102, such as, e.g., a bottom hole assembly (BHA), in accordance with various implementations described herein.

As shown in FIG. 1, the BHA 102 is shown inserted downhole into a wellbore 105 that is being surveyed. The BHA 102 may have a controller 110 and multiple survey tools 104, such as, e.g., a first survey tool 104A and a second survey tool 104B. Also, each survey tool 104 may include one or more sensors 120 that are arranged as instrumentation in an instrument cluster. For instance, as shown, the first survey tool 104A may include one or more first sensors 120A in a first instrument cluster, and the second survey tool 104B may include one or more second sensors 120B in a second instrument cluster. Also, using the BHA 102, data collected and/or received from at least a section of the wellbore 105 may be used in processing GWD survey data during a drilling process. In various instances, processing GWD survey data may be performed downhole with the controller 110 installed within the BHA 102 or at the surface with surface devices when data from the GWD tools (or sensor system) are sent to the surface. In this manner, the combination of the two individual surveys may be carried out in a downhole processor with results being sent to the surface. Alternatively, both individual surveys may be transmitted to the surface, and combination of data (e.g. by the weighted averaging process) may be conducted by a surface computer. Although various implementations described herein are described with reference to GWD tools, it should be understood however that MWD tools may be used as part of the survey tools with the with the various implementation described herein. In some instances, an MWD tool is run in addition to a GWD tool. In the various implementations described herein, an MWD tool may be run in addition to the two GWD tools, and not as a replacement for one of the two GWD tools.

In some implementations, as shown, the BHA 102 may be an apparatus having multiple survey tools 104, including a first survey tool 104A and a second survey tool 104B. The first survey tool 104A may be disposed within a wellbore 105 and may acquire first survey data, such as, e.g., first GWD survey data. The second survey tool 104B may also be disposed within the wellbore 105 and may acquire second survey data, such as, e.g., second GWD survey data. In some instances, the first survey tool 104A and the second survey tool 104B may be coupled together in sequence (or in series) within the BHA 102. Also, the BHA 102 may include the controller 110 that receives the first survey data from the first survey tool 104A, receives the second survey data from the second survey tool 104B, and generates at least one survey of the wellbore 105 based on the first survey data and the second survey data for enhancing directional control of wellbore trajectories, e.g., associated with the wellbore 105.

In some instances, the at least one survey may be generated for the directional control of wellbore trajectories through use of dual GWD systems. As described herein below, the first survey tool 104A may include one or more first gyroscopic sensors, and the second survey tool 104B may include one or more second gyroscopic sensors. Also, the first survey tool 104A may include one or more first accelerometers and one or more first magnetometers, and the second survey tool 104B may include one or more second accelerometers and one or more second magnetometers. In some instances, the first survey tool 104A may be configured to acquire the first survey data at a first start time, and the second survey tool 104B may be configured to acquire the second survey data at a second start time that is different than the first start time. In other instances, the first survey tool 104A and the second survey tool 104B may be configured to acquire survey data at a same time and/or over a same period of time.

In some instances, the BHA 102 may use the controller 110 to generate the survey by comparing the first survey data and the second survey data with predetermined values, by generating a first survey based on the first survey data and a second survey based on the second survey data, and also by computing a weighted average of the first survey and the second survey. Further, in some instances, the first survey data acquired by the first survey tool 104A and the second survey data acquired by the second survey tool 104B may be checked for quality control (QC) purposes. In this instance, quality control checks may include various checks on each survey tool 104A, 104B based on measurements generated internally by each survey tool 104A, 104B, and quality control checks may include comparison of survey data generated by each survey tool 104A, 104B to ensure survey differences are within predefined tolerances. As known in the art, the BHA 102 may be located at a lower end of a rotating drill shaft to which the drill bit is coupled.

In some implementations, communication with surface devices may be by mud pulse telemetry or electromagnetic magnetic telemetry (EMT), wired pipe or any other type of telemetry. In other implementations, when estimation processing is performed downhole (e.g., with the controller 110 installed within the BHA 102), only collected GWD data may be sent to the surface.

To date, high precision gyroscopic surveys have been based on application of mechanical spinning wheel gyroscopic sensors. Such instruments are subject to a variety of error sources, including gravity dependent errors resulting from mass unbalance and other imperfections within the sensor. Careful calibration and on-line correction methods allow maintaining such effects to be maintained to within acceptable levels. Relatively new sensor technology, such as, e.g., Coriolis vibratory gyros (CVGs) and micro-electro mechanical sensors (MEMS), have been developed to achieve a level of performance comparable with other mechanical gyros used in oilfield applications. Such instruments may be less susceptible to gravity-dependent effects, making them easier to use without concern over the effect that gravity-dependent errors may be having on survey accuracy. In some instances, survey data may be generated and transmitted to surface devices so as to allow a directional driller to enhance control wellbore trajectory and/or use the BHA 102 as part of an automated well trajectory control process.

In some implementations, the BHA 102 is implemented as an apparatus for the enhancement of a directional survey conducted during the creation of a wellbore through the deployment of two or more GWD tools in a drill string. As such, the BHA 102 provides for deployment of two or more GWD tools, and the BHA 102 provides for processing of two or more sets of survey data collected at different start times, wherein the respective data collection intervals may overlap. Also, the BHA 102 provides for comparison and checking for agreement between the two or more resulting directional surveys, and the BHA 102 provides for combination of the two surveys via a weighted averaging process to generate the final survey corresponding to each depth station. This and various other features related to the BHA 102 will be described herein below.

Figure 2:
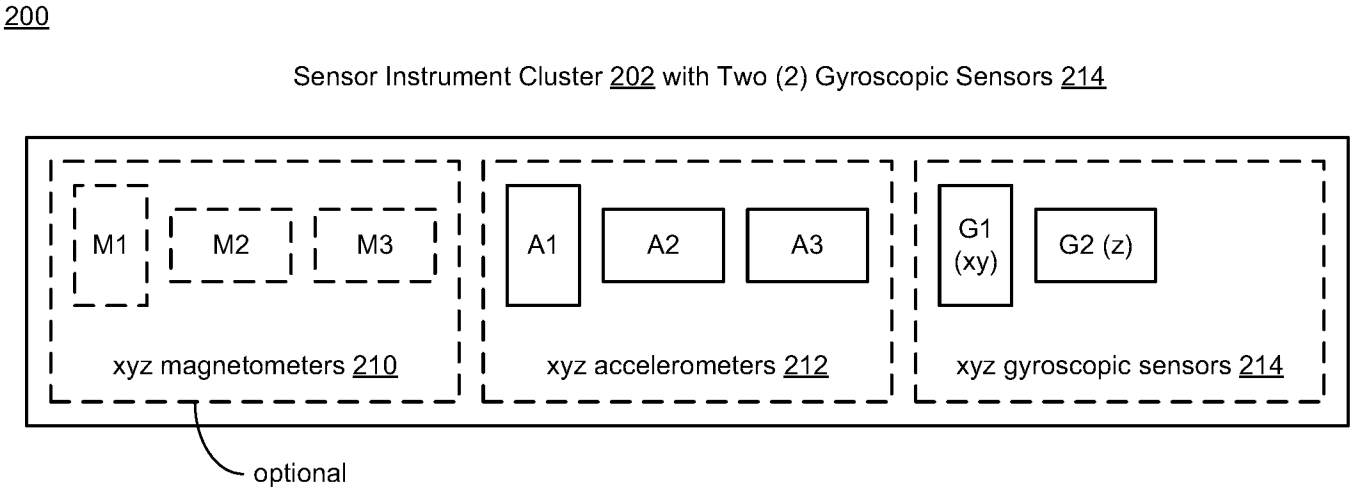
FIGS. 2-3 illustrate diagrams of a sensor instrument cluster having gyroscopic sensors in accordance with various implementations described herein.
Figure 3:
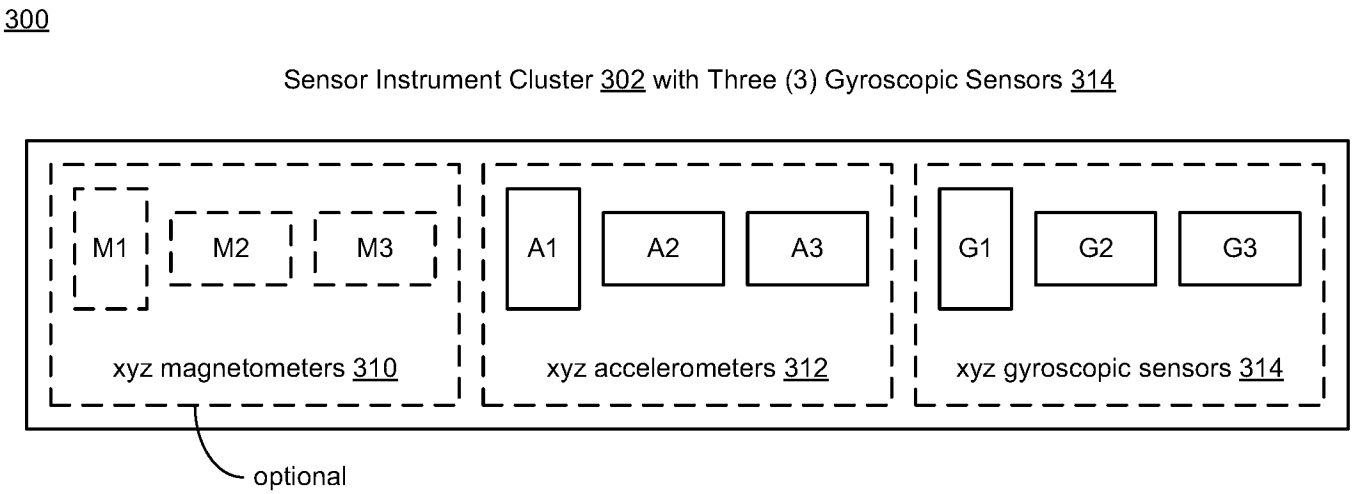

FIGS. 2-3 illustrate diagrams 200, 300 of sensor instrument clusters 202, 302 having gyroscopic sensors 214, 314 in accordance with some implementations described herein. In particular, FIG. 2 illustrates a diagram 200 of a sensor instrument cluster 202 having two gyroscopic sensors 214, and FIG. 3 illustrates a diagram 300 of another sensor instrument cluster 302 having three gyroscopic sensors 314.

As shown in FIG. 2, the sensor instrument cluster 202 has multiple sensors, including, e.g., multiple accelerometers 212 and multiple gyroscopic sensors 214. Generally, the sensors (gyros and accelerometers) are usually mounted to generate measurements about three orthogonal axes (x, y and z) that are nominally aligned with the xyz axes of the tool. In addition, the multiple accelerometers 212 may include three (3) accelerometers (A1, A2, A3) that are arranged and configured for x, y, and z axes with respect to the tool. Also, the multiple gyroscopic sensors 214 may include two (2) gyroscopic sensors (G1, G2), which refer to two dual-axis gyros, e.g., an xy-gyro and a z-gyro, respectively. In some cases, the sensor instrument cluster 202 may also include magnetometers 210, which may include M1, M2 and M3.

As shown in FIG. 3, the sensor instrument cluster 302 has multiple sensors, including, e.g., multiple accelerometers 212 and multiple gyroscopic sensors 214. In some instances, the multiple accelerometers 212 may include three (3) accelerometers (A1, A2, A3) that are arranged and configured for x, y, and z axes with respect to the tool. Also, the multiple gyroscopic sensors 214 may include three (3) single-axis gyroscopic sensors (G1, G2, G3) that are arranged and configured for x, y, and z axes with respect to the tool.

Figure 4:
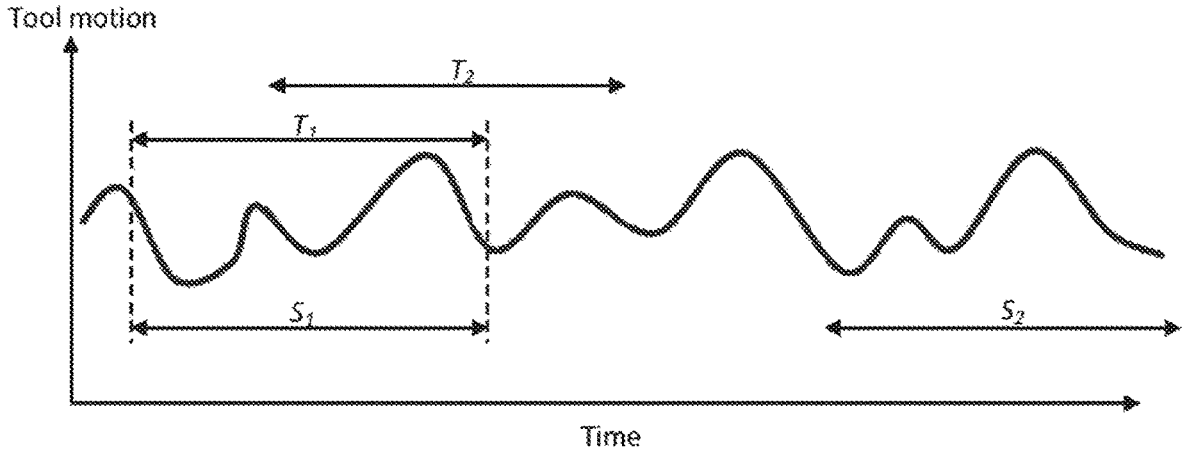
FIG. 4 illustrates a waveform diagram of the difference in duration of single and dual gyro-while-drilling (GWD) survey procedures in accordance with various implementations described herein.

FIG. 4 illustrates a waveform diagram 400 of a difference in duration of single and dual GWD survey procedures in accordance with various implementations described herein.

The pictorial representation shown in FIG. 4 demonstrates the difference in duration of single and dual GWD survey procedures. In FIG. 4, the curve represents motion of a survey tool(s) plotted in reference to time. Where two surveys (e.g., denoted $S_1$ and $S_2$) are taken using a single tool, the time taken to collect the survey data for each survey is represented by the lengths of the lines lengths of the lines $S_1$ and $S_2$. The delay between completion of a first survey (1) and start of a second survey (2) is the time taken to communicate with the survey tool before the second survey begins. Therefore, in this instance, the overall time taken to gather and verify a survey refers to the sum of the two individual survey times and the pump re-cycle time.

Where two separate GWD tools are deployed, timings of the surveys taken by a first survey tool (1) and a second survey tool (2) (e.g., denoted $T_1$ and $T_2$) may partially overlap as depicted in the figure, allowing the overall duration of the survey procedure at each station to be reduced substantially. As indicated in the figure, the two surveys are taken deliberately at different phases of any cyclic motion that may be present to ensure that motion-dependent effects are not disguised when comparing the two results.

In addition to the reduction in overall survey time, other benefits to be gained through the deployment of two tools include the more rigorous quality control of the data and an improvement in the overall accuracy of the survey data generated. As described, e.g., in Ekseth et al., "High-Integrity Wellbore Surveying", SPE Drilling & Completion, 2010, pages 438-447, which is herein incorporated by reference, a data check comprising one or more of combined comparisons of inclinations, azimuths and coordinates relative to an independent verification survey may refer to a substantially powerful quality control (QC) test method. However, value of checks relative to independent verification surveys may depend on a degree of independence relative to a verification survey, and verification surveys may be totally independent only as long as it is performed with a different survey method, a different survey tool and different running gear/BHA.

For the implementations described herein, although the second survey may not be entirely independent of the first, the surveys may be conducted with entirely separate sensors. Therefore, the dual GWD tools provide for a check on tool performance. Also, in reference to overall survey accuracy, given that each tool satisfies its own internal QC objectives, and given that two surveys are in agreement within an acceptable tolerance, a weighted average of the two results may be used to generate a final survey (or combined survey) at each station. For the case described herein, where two tools of identical type are used, a straight average of the two results may be taken, and the accuracy of the final survey may be increased by a factor of $1/\sqrt{2}$. In general, if more than two tools were to be deployed, a reduction in the resulting survey errors of $1/\sqrt{n}$ may be claimed, where n is the number of tools deployed.

Where implementations of the types described here are adopted, performance of the two, or more, tool measurement process will be reflected in the tool dependent parameters of the instrument performance model. In some implementations, a computing system (e.g., computer system 600 shown in FIG. 6) may be used to process the data acquired by the survey tools during the data acquisition. In particular, for instance, based on the acquired data, the computing system may be used to generate a survey of the wellbore. In one implementation, the computing system may be located at the surface, and may be configured to receive or download the recorded data from the tools after the tools have been retrieved from the wellbore using any form of communications known to those skilled in the art. In other implementations, a computing system may be configured to receive or download the acquired data from the tools as the tools traverse the wellbore using any form or type of communication known to those skilled in the art. In various other implementations, the computing system may include an on-board computing system that may be used instead of, or in conjunction with, the various computing systems mentioned above. Also, the computing system may be any computing system implementation known to those skilled in the art, and various implementations of the computing system are further discussed in greater detail herein below.

Figure 5:
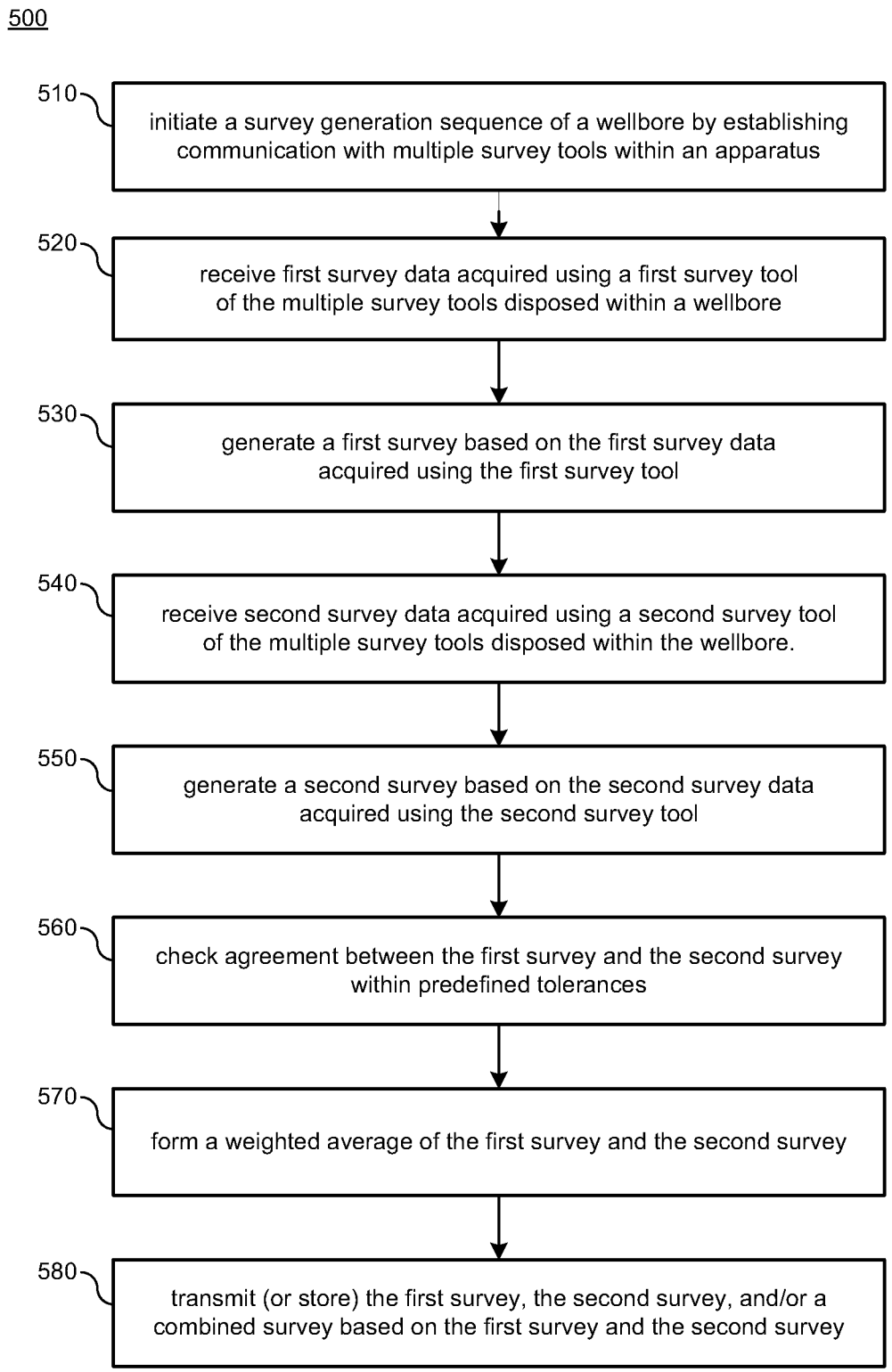
FIG. 5 illustrates a process diagram of a method for implementing directional control of wellbore trajectories in accordance with implementations described herein.

FIG. 5 illustrates a process diagram of a method 500 for enhancing directional control of wellbore trajectories in accordance with implementations described herein.

It should be understood that even though method 500 may indicate a particular order of operation execution, in some cases, various certain portions of the operations may be executed in a different order, and on different systems. In other cases, additional operations and/or steps may be added to and/or omitted from method 500. Method 500 may be implemented as a program or software instruction process that may be used for implementing sensor integration for enhanced directional control of wellbore trajectories as described herein. In addition, if implemented in software, various instructions related to implementing method 500 may be stored in memory and/or a database. For instance, a computer or various other types of computing devices (e.g., computer system 600 shown in FIG. 6) having a processor (or controller) and memory may be configured to perform method 500 in accordance with schemes and techniques described herein.

In reference to FIG. 5, method 500 may be used for receiving and processing of multiple sets of survey data taken during a drilling process at each survey station in accordance with various implementations of some techniques described herein. In some instances, method 500 provides for conducting real-time wellbore surveys as part of the drilling process using two or more gyro based survey tools. As described herein, some advantages of using at least two gyro based survey tools with method 500 may include a reduction in overall survey time, enhanced data quality control, and enhanced accuracy of a resulting survey.

At block 510, method 500 initiates a survey generation sequence of a wellbore by establishing communication with multiple survey tools within an apparatus, such as, a BHA. As described herein, method 500 may be used to enhance directional control of wellbore trajectories through use of dual GWD systems. In various implementations, application of dual GWD systems may be advantageously used so as to reduce the time needed to collect a survey, to enhance quality control (QC), to provide confidence in the survey, and also to improve survey accuracy.

At block 520, method 500 may receive first survey data acquired using a first survey tool of the multiple survey tools disposed within a wellbore. In some instances, the first survey tool is coupled together with one or more other survey tools in sequence within the BHA. Also, the first survey tool may include one or more first gyroscopic sensors. In addition, the first survey tool may also include one or more first accelerometers and one or more first magnetometers. Further, the first survey tool may be configured to acquire the first survey data at a first start time.

At block 530, method 500 may generate a first survey based on the first survey data acquired using the first survey tool. The method 500 may generate at least one first survey of the wellbore based on the first survey data for directional control of wellbore trajectories through use of dual gyro while drilling systems. In some instances, generating the first survey may include conducting data quality checks of the first survey data. The first survey may be referred to as a first directional survey for enhancing directional control of wellbore trajectories associated with the wellbore. Also, enhancing directional control of wellbore trajectories may be through use of dual GWD systems.

At block 540, method 500 may receive second survey data acquired using a second survey tool of the multiple survey tools disposed within the wellbore. In some instances, the second survey tool is coupled together with the first survey tool in sequence within the BHA. Also, the second survey tool may include one or more second gyroscopic sensors. In addition, the second survey tool may also include one or more second accelerometers and one or more second magnetometers. In some cases, the second survey tool may be configured to acquire the second survey data at a second start time that is different than the first start time. However, in other cases, the first survey tool and the second survey tool may be configured to acquire survey data at a same time, wherein the second start time is similar to the first start time.

At block 550, method 500 may generate a second survey based on the second survey data acquired using the second survey tool. The method 500 may generate at least one second survey of the wellbore based on the second survey data for directional control of wellbore trajectories through use of dual gyro while drilling systems. In some instances, generating the second survey may include conducting data quality checks of the second survey data. The second survey may be referred to as a second directional survey for enhancing directional control of wellbore trajectories associated with the wellbore. Also, enhancing directional control of wellbore trajectories may be through use of dual GWD systems. In some instances, method 500 may generate a combined survey based on the first survey data and the second survey data for directional control of wellbore trajectories through use of dual gyro while drilling systems.

At block 560, method 500 may confirm agreement between the first survey and the second survey within predefined tolerances. In some instances, confirming agreement may include comparing the first survey data (and/or the first survey) to the second survey data (and/or the second survey). At block 570, method 500 may form (or determine) a weighted average of the first survey and the second survey. At block 580, method 500 may transmit (or store) the first survey, the second survey, and/or a combined survey based on the first survey and the second survey. In some instances, the first survey data, the first survey, the second survey data, and the second survey may be stored in memory or some type of database. Also, the combined survey that is based on the first survey and the second survey may be stored in memory or some type of database.

Thus, in some implementations, method 500 may generate at least one survey by comparing the first survey data and the second survey data with predetermined values, by generating the first survey based on the first survey data and the second survey based on the second survey data, and by computing the weighted average of the first survey and the second survey. Also, method 500 may check the first survey data acquired by the first survey tool and the second survey data acquired by second survey tool for quality control (QC) purposes. In this instance, the quality control checks may include checks on each survey tool based on measurements generated internally by each tool, and the quality control checks may include comparison of survey data generated by each tool to ensure survey differences are within predefined tolerances.

Figure 6:
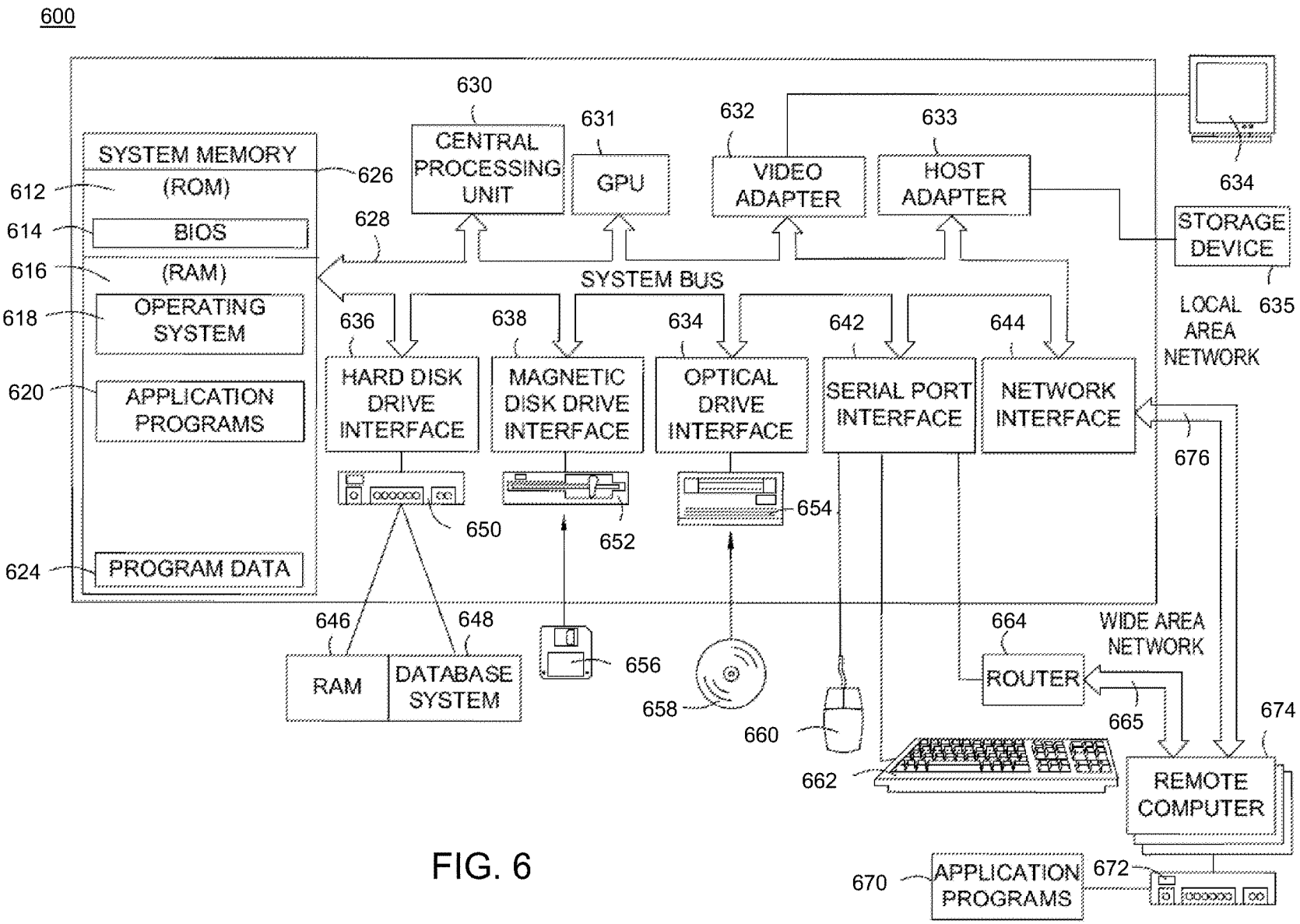
FIG. 6 illustrates a diagram of a computing system in accordance with various implementations described herein.

In some implementations, it should be appreciated that a computer or computer system, such as, e.g., computer system 600 shown in FIG. 6, may be used to perform the method 500 of FIG. 5. As described herein below, the computer system 600 shown in FIG. 6 may have one or more processors and memory, such as, e.g., a non-transitory computer readable medium, for storing instructions. Therefore, in this instance, the non-transitory computer-readable medium (CRM) may have stored (or recorded) thereon a plurality of computer-executable instructions that, when executed by the computer system (or one or more processors related thereto), cause the computer system (or the one or more processors related thereto) to perform the method 500 of FIG. 5.

In some implementations, after establishing communication with the first survey tool, the survey process may be initiated. Following collection of sensor measurements, a directional survey may be computed, and internal quality checks may be conducted in line with accepted procedures. This may involve checking the measured total gravity field and Earth rate against known values for each, and then confirmation that measurement noise lie within acceptable levels. A short time later, allowing time for a change in phase of any cyclic motion that is expected to be present, a second survey may be generated using a second survey tool, which may be initiated automatically, and the same process of data collection, processing, and checking may be conducted with the second tool. If both surveys are acceptable, QC checks may be performed to ensure that the resulting azimuth and inclination values agree to within pre-defined tolerances. After a successful outcome of this test, weighted average values of the measured azimuth and inclination may then be computed. The resulting survey may be transmitted to surface and stored.

Various implementations for dual gyro-based survey tool system are disclosed herein for enhancing directional control of wellbore trajectories through use of dual gyro while drilling (GWD) systems. The advantages of such a system may include a reduction in the overall survey time, enhanced data quality control, and enhanced accuracy of the resulting survey. Various implementations of computing systems are discussed herein below, and implementations of various technologies described herein may be operational with numerous general purpose or special purpose computing system environments or configurations. Examples of computing systems, environments, and/or configurations that may be suitable for use with the various technologies described herein include, but are not limited to, personal computers, server computers, hand-held or laptop devices, multiprocessor systems, microprocessor-based systems, set top boxes, programmable consumer electronics, network PCs, minicomputers, mainframe computers, smart phones, smart watches, personal wearable computing systems networked with other computing systems, tablet computers, and distributed computing environments that include any of the above systems or devices, and the like.

The various technologies described herein may be implemented in the general context of computer-executable instructions, such as program modules, being executed by a computer. Generally, program modules include routines, programs, objects, components, data structures, etc. that performs particular tasks or implement particular abstract data types. While program modules may execute on a single computing system, it should be appreciated that, in some implementations, program modules may be implemented on separate computing systems or devices adapted to communicate with one another. A program module may also be some combination of hardware and software where particular tasks performed by the program module may be done either through hardware, software, or both.

The various technologies described herein may be implemented in distributed computing environments where tasks are performed by remote processing devices that are linked through a communications network, e.g., by hardwired links, wireless links, or combinations thereof. Also, the distributed computing environments may span multiple continents and multiple vessels, ships or boats. In a distributed computing environment, program modules may be located in both local and remote computer storage media including memory storage devices.

FIG. 6 illustrates a schematic diagram of a computing system 600 in which the various technologies described herein may be incorporated and practiced. Although the computing system 600 may be a conventional desktop or a server computer, as described above, other computer system configurations may be used.

The computing system 600 may include a central processing unit (CPU) 630, a system memory 626, a graphics processing unit (GPU) 631 and a system bus 628 that couples various system components including the system memory 626 to the CPU 630. Although one CPU is illustrated in FIG. 6, it should be understood that in some implementations the computing system 600 may include more than one CPU. The GPU 631 may be a microprocessor specifically designed to manipulate and implement computer graphics. The CPU 630 may offload work to the GPU 631. The GPU 631 may have its own graphics memory, and/or may have access to a portion of the system memory 626. As with the CPU 630, the GPU 631 may include one or more processing units, and the processing units may include one or more cores. The system bus 628 may be any of several types of bus structures, including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus. The system memory 626 may include a read-only memory (ROM) 612 and a random access memory (RAM) 646. A basic input/output system (BIOS) 614, containing the basic routines that help transfer information between elements within the computing system 600, such as during start-up, may be stored in the ROM 612.

The computing system 600 may further include a hard disk drive 650 for reading from and writing to a hard disk, a magnetic disk drive 652 for reading from and writing to a removable magnetic disk 656, and an optical disk drive 654 for reading from and writing to a removable optical disk 658, such as a CD ROM or other optical media. The hard disk drive 650, the magnetic disk drive 652, and the optical disk drive 654 may be connected to the system bus 628 by a hard disk drive interface 656, a magnetic disk drive interface 658, and an optical drive interface 650, respectively. The drives and their associated computer-readable media provide non-volatile storage of computer-readable instructions, data structures, program modules and other data for the computing system 600.

Although the computing system 600 is described herein as having a hard disk, a removable magnetic disk 656 and a removable optical disk 658, it should be appreciated by those skilled in the art that the computing system 600 may also include other types of computer-readable media that may be accessed by a computer. For example, such computer-readable media may include computer storage media and communication media. Computer storage media may include volatile and non-volatile, and removable and non-removable media implemented in any method or technology for storage of information, such as computer-readable instructions, data structures, program modules or other data. Computer storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium which may be used to store the desired information and which may be accessed by the computing system 600.

Communication media may embody computer readable instructions, data structures, program modules or other data in a modulated data signal, such as a carrier wave or other transport mechanism and may include any information delivery media. The term "modulated data signal" may mean a signal that has one or more of its characteristics set or changed in such a manner as to encode information in the signal. By way of example, and not limitation, communication media may include wired media such as a wired network or direct-wired connection, and wireless media such as acoustic, RF, infrared and other wireless media. The computing system 600 may also include a host adapter 633 that connects to a storage device 635 via a small computer system interface (SCSI) bus, a Fiber Channel bus, an eSATA bus, or using any other applicable computer bus interface. Combinations of any of the above may also be included within the scope of computer readable media.

A number of program modules may be stored on the hard disk 650, magnetic disk 656, optical disk 658, ROM 612 or RAM 616, including an operating system 618, one or more application programs 620, program data 624, and a database system 648. The application programs 620 may include various mobile applications ("apps") and other applications configured to perform various methods and techniques described herein. The operating system 618 may be any suitable operating system that may control the operation of a networked personal or server computer, such as Windows® XP, Mac OS® X, Unix-variants (e.g., Linux® and BSD®), and the like.

A user may enter commands and information into the computing system 600 through input devices such as a keyboard 662 and pointing device 660. Other input devices may include a microphone, joystick, game pad, satellite dish, scanner, or the like. These and other input devices may be connected to the CPU 630 through a serial port interface 642 coupled to system bus 628, but may be connected by other interfaces, such as a parallel port, game port or a universal serial bus (USB). A monitor 634 or other type of display device may also be connected to system bus 628 via an interface, such as a video adapter 632. In addition to the monitor 634, the computing system 600 may further include other peripheral output devices such as speakers and printers.

Further, the computing system 600 may operate in a networked environment using logical connections to one or more remote computers 674. The logical connections may be any connection that is commonplace in offices, enterprise-wide computer networks, intranets, and the Internet, such as local area network (LAN) 656 and a wide area network (WAN) 665. The remote computers 674 may be another a computer, a server computer, a router, a network PC, a peer device or other common network node, and may include many of the elements describes above relative to the computing system 600. The remote computers 674 may also each include application programs 670 similar to that of the computer action function.

When using a LAN networking environment, the computing system 600 may be connected to the local network 676 through a network interface or adapter 644. When used in a WAN networking environment, the computing system 600 may include a router 664, wireless router or other means for establishing communication over a wide area network 665, such as the Internet. The router 664, which may be internal or external, may be connected to the system bus 628 via the serial port interface 652. In a networked environment, program modules depicted relative to the computing system 600, or portions thereof, may be stored in a remote memory storage device 672. It will be appreciated that the network connections shown are merely examples and other means of establishing a communications link between the computers may be used.

The network interface 644 may also utilize remote access technologies (e.g., Remote Access Service (RAS), Virtual Private Networking (VPN), Secure Socket Layer (SSL), Layer 2 Tunneling (L2T), or any other suitable protocol). These remote access technologies may be implemented in connection with the remote computers 674.

It should be understood that the various technologies described herein may be implemented in connection with hardware, software or a combination of both. Thus, various technologies, or certain aspects or portions thereof, may take the form of program code (i.e., instructions) embodied in tangible media, such as floppy diskettes, CD-ROMs, hard drives, or any other machine-readable storage medium wherein, when the program code is loaded into and executed by a machine, such as a computer, the machine becomes an apparatus for practicing the various technologies. In the case of program code execution on programmable computers, the computing device may include a processor, a storage medium readable by the processor (including volatile and non-volatile memory and/or storage elements), at least one input device, and at least one output device. One or more programs that may implement or utilize the various technologies described herein may use an application programming interface (API), reusable controls, and the like. Such programs may be implemented in a high level procedural or object oriented programming language to communicate with a computer system. However, the program(s) may be implemented in assembly or machine language, if desired. In any case, the language may be a compiled or interpreted language, and combined with hardware implementations. Also, the program code may execute entirely on a user's computing device, on the user's computing device, as a stand-alone software package, on the user's computer and on a remote computer or entirely on the remote computer or a server computer.

Those with skill in the art should appreciate that various listed architectures, features or standards discussed herein above with respect to the computing system 600 may be omitted for use with one or more other computing system used in accordance with the various implementations disclosed herein due to technology and standards that may continue to evolve over time in the modern industry.

While the foregoing is directed to implementations of various technologies described herein, other and further implementations may be devised without departing from the basic scope thereof. Although the subject matter has been described in language specific to structural features and/or methodological acts, it is to be understood that the subject matter defined in the appended claims is not limited to the specific features or acts described above. Rather, the specific features and acts described above are disclosed as example forms of implementing the claims.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Depending on the embodiment, certain acts, events, or functions of any of the methods described herein may be performed in a different sequence, may be added, merged, or left out completely (e.g., not all described acts or events are necessary for the practice of the method). Moreover, in certain embodiments, acts or events may be performed concurrently, e.g., through multi-threaded processing, interrupt processing, or multiple processors or processor cores, rather than sequentially.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. The described functionality may be implemented in varying ways for each particular application, but such implementation decisions should not be interpreted as causing a departure from the scope of the disclosure.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor can also be implemented as a combination of computing devices, e.g., a combination of a DSP and a microprocessor, a plurality of microprocessors, one or more microprocessors in conjunction with a DSP core, or any other such configuration.

The blocks of the methods and algorithms described in connection with the embodiments disclosed herein may be embodied directly in hardware, in a software module executed by a processor, or in a combination of the two. A software module can reside in RAM memory, flash memory, ROM memory, EPROM memory, EEPROM memory, registers, a hard disk, a removable disk, a CD-ROM, or any other form of computer-readable storage medium known in the art. An exemplary tangible, computer-readable storage medium is coupled to a processor such that the processor can read information from, and write information to, the storage medium. In the alternative, the storage medium may be integral to the processor. The processor and the storage medium can reside in an ASIC. The ASIC can reside in a user terminal. In the alternative, the processor and the storage medium can reside as discrete components in a user terminal.

While the above detailed description has shown, described, and pointed out novel features as applied to various embodiments, it will be understood that various omissions, substitutions, and changes in the form and details of the devices or algorithms illustrated may be made without departing from the spirit of the disclosure. As will be recognized, certain embodiments described herein may be embodied within a form that does not provide all of the features and benefits set forth herein, as some features may be used or practiced separately from others. The scope of certain inventions disclosed herein is indicated by the appended claims rather than by the foregoing description. All changes which come within the meaning and range of equivalency of the claims are to be embraced within their scope.

What is claimed is:

1. A method, comprising:

receiving first gyro-while-drilling (GWD) survey data acquired using a first survey tool disposed within a wellbore;

receiving second GWD survey data acquired using a second survey tool disposed within the wellbore; and generating a survey of the wellbore based on the first GWD survey data and the second GWD survey data for directional control of wellbore trajectories;

wherein the first survey tool and the second survey tool are configured to acquire survey data at partially overlapping time periods, including at different phases of cyclic motion of the survey tools.

2. The method of claim 1, wherein the survey is generated for the directional control of wellbore trajectories through use of dual GWD systems.

3. The method of claim 1, wherein of the first survey tool and the second survey tool are mounted within a bottom hole assembly (BHA).

4. The method of claim 1, wherein the first survey tool comprises one or more first gyroscopic sensors and one or more accelerometers, and wherein the second survey tool comprises one or more second gyroscopic sensors and one or more accelerometers.

5. The method of claim 4, wherein at least one of the first survey tool and the second survey tool further comprises a measurement while drilling (MWD) tool.

6. The method of claim 1, wherein the first survey tool is configured to acquire the first survey data at a first start time, and wherein the second survey tool is configured to acquire the second survey data at a second start time that is different than the first start time.

7. The method of claim 1, wherein the first survey tool and the second survey tool are configured to acquire survey data at a same time in the partially overlapping time period.

8. The method of claim 1, wherein generating the survey comprises:

comparing the first survey data and the second survey data with predetermined values;

generating a first survey based on the first survey data and a second survey based on the second survey data; and computing a weighted average of the first survey and the second survey.

9. The method of claim 1, wherein the first survey data acquired by the first survey tool and the second survey data acquired by second survey tool are checked for quality control purposes, and wherein quality control checks comprise:

checks on each survey tool based on measurements generated internally by each tool; and comparison of survey data generated by each tool to ensure survey differences are within predefined tolerances.

10. An apparatus, comprising:

a first survey tool disposed within a wellbore, wherein the first survey tool acquires first gyro-while-drilling (GWD) survey data; and a second survey tool disposed within the wellbore, wherein the second survey tool acquires second GWD survey data, a controller that receives the first GWD survey data from the first survey tool, receives the second GWD survey data from the second survey tool, and generates a survey of the wellbore based on the first GWD survey data and the second GWD survey data for directional control of wellbore trajectories;

wherein the first survey tool and the second survey tool are configured to acquire survey data at partially overlapping time periods, including at different phases of cyclic motion of the apparatus.

11. The apparatus of claim 10, wherein of the apparatus comprises a bottom hole assembly (BHA).

12. The apparatus of claim 10, wherein the survey is generated for the directional control of wellbore trajectories through use of dual gyro while drilling systems.

13. The apparatus of claim 10, wherein the first survey tool and the second survey tool are installed within the apparatus.

14. The apparatus of claim 10, wherein at least one of the first survey tool and the second survey tool comprises a measurement while drilling (MWD) tool.

15. The apparatus of claim 14, wherein the first survey tool comprises one or more first gyroscopic sensors and one or more accelerometers, and wherein the second survey tool comprises one or more second gyroscopic sensors and one or more accelerometers.

16. The apparatus of claim 10, wherein the first survey tool is configured to acquire the first survey data at a first start time, and wherein the second survey tool is configured to acquire the second survey data at a second start time that is different than the first start time.

17. The apparatus of claim 10, wherein the first survey tool and the second survey tool are configured to acquire survey data at a same time.

18. The apparatus of claim 10, wherein the survey of the wellbore is generated by:

comparing the first survey data and the second survey data with predetermined values;

generating a first survey based on the first survey data and a second survey based on the second survey data; and computing a weighted average of the first survey and the second survey.

19. The apparatus of claim 10, wherein the first survey data acquired by the first survey tool and the second survey data acquired by second survey tool are checked for quality control purposes, and wherein quality control checks comprise:

checks on each survey tool based on measurements generated internally by each survey tool; and comparison of the survey data generated by each survey tool to ensure survey differences are within predefined tolerances.

20. A non-transitory computer-readable medium having stored thereon a plurality of computer-executable programs that, when executed by a processor, cause the processor to:

receive first gyro-while-drilling (GWD) survey data acquired using a first survey tool disposed within a wellbore;

receive second GWD survey data acquired using a second survey tool disposed within the wellbore; and generate at least one survey of the wellbore based on the first GWD survey data and the second GWD survey data for directional control of wellbore trajectories;

wherein the first survey tool and the second survey tool are configured to acquire survey data at partially overlapping time periods, including at different phases of cyclic motion of the survey tools.

* * * * *